United States Patent [19]

Gneiting

[11] 4,174,701

[45] Nov. 20, 1979

[54] FIREPLACE SYSTEM

[76] Inventor: Thayne R. Gneiting, Rte. 4, Box 256, Blackfoot, Id. 83221

[21] Appl. No.: 793,377

[22] Filed: May 3, 1977

[51] Int. Cl.[2] ..... F24B 7/00

[52] U.S. Cl. ..... 126/121; 165/175; 237/51

[58] Field of Search ..... 126/121, 135, 129, 131, 126/140, 163 R; 165/175; 237/51

[56] References Cited

U.S. PATENT DOCUMENTS

| | | | |
|---|---|---|---|
| 3,942,509 | 3/1976 | Sasser | 126/121 |
| 4,018,209 | 4/1977 | Bonvicini | 126/121 |

FOREIGN PATENT DOCUMENTS

| | | | |
|---|---|---|---|
| 226785 | 2/1960 | Australia | 126/121 |
| 978392 | 12/1964 | United Kingdom | 126/121 |

*Primary Examiner*—Edgar W. Geoghegan
*Attorney, Agent, or Firm*—George R. Douglas

[57] ABSTRACT

A fireplace system comprising a grate consisting of a plurality of parallel hollow members for holding logs having a rear header in communication with the hollow member for supplying fresh air to be passed through the hollow tubular members. The tubular members have discharge apertures therein for supplying air to support combustion. The front of the tubular members are provided with a header in communication with a muffler system for discharging heated air into a room.

2 Claims, 3 Drawing Figures

FIREPLACE SYSTEM

The present invention relates to a fireplace system, and more particularly to a device that is provided with means for conserving energy and utilizing conduction and convection heat transfer from the burning logs in the fireplace to the room to be heated.

It is well known that fireplaces although providing heat to a room are normally rather inefficient and with the present crisis, it is an object of the present invention to provide a fireplace device to permit more heat transfer from the fireplace to the room and to thereby conserve energy.

It is another object of the present invention to increase the heating capacity of existing fireplaces so that more heat is provided for a given amount of fuel thus resulting in fuel savings for normal requirements.

It is yet another object of the present invention to provide a closed in fireplace with sliding glass doors to eliminate loss of heat from the room and to prevent smoke and ashes from getting into the living space which it serves.

Another object of the present invention is to provide a fireplace with hollow heating transfer grates and muffler means and a power driven fan means for moving the heated air into the room.

A further object of the present invention is to provide a fireplace device that brings in fresh air to be heated from outside of the house under pressure thereby making the inside air pressure in the room greater than outside of the house or building.

Another object of the present invention is to provide a fireplace system which introduces heated air under pressure into the room so as to lessen the seepage of cold air in through cracks and gaps and to decrease the rush of cold air into the room when an outside door is open.

Another object of the present invention is to provide a fireplace system utilizing fresh air for supporting combustion to provide a healthier environment in the space in which it is utilized.

A still further object of the present invention is to provide an arrangement of partitions for distributing the heated air and which further serves as a silencer of the moving air into the room to provide a quiet functioning system.

Various other objects and advantages of the present invention will be readily apparent from the following detailed description when considered in connection with the accompanying drawing forming a part thereof and in which.

Figure 2:
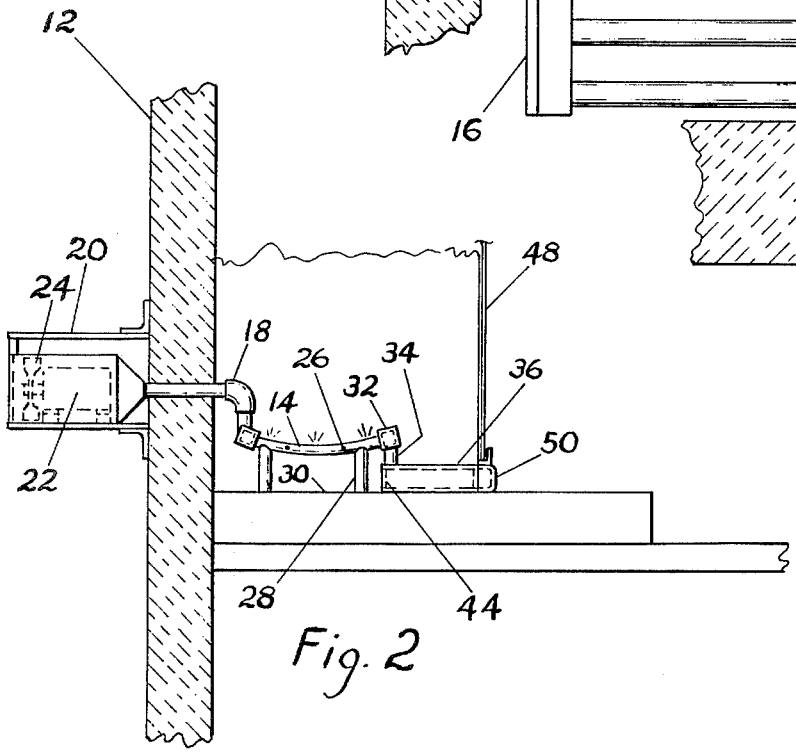
FIG. 2 is a side elevational view of the fireplace system embodied in the present invention.

Referring to the drawings, the reference numeral 10 generally designates a fireplce with a rear wall 12 forming the side of the building or house. Disposed in the fireplace are a plurality of parallel slightly curved hollow tubular members 14 having their rear ends connected to a horizontally extending header 16 which forms an entrance chamber for the inlet of fresh air. The header 16 has a centrally disposed inlet conduit 18 for supplying fresh air from outside of the wall 12 to the members 14. The tubular member 18 in turn is in communication with a housing 20 in which is disposed a variable speed motor 22 and its intake fan 24 for supplying fresh air to tubular member 18 and the header 16 and members 14, as best seen in FIG. 2. The motor may be of any conventional type and, of course, is connected or plugged in by an electrical cord to any switch in the house electrical system.

The tubular members 14 are provided with a plurality of apertures 26 to discharge the fresh air into the fireplace to support combustion. The logs, of course, are disposed on the members 14 which act as a grate. The members 14 are supported by vertical supports 28 in the fireplace and disposed on the fireplace bottom 30.

The front ends of the tubular members 14 are connected to a front header 32 for discharging heated air from members 14.

A pipe connecting member 34 extends below the front header 32 and in turn is connected to a substantially horizontal rectangular housing 36 for receiving heated air from header 32.

Figure 3:
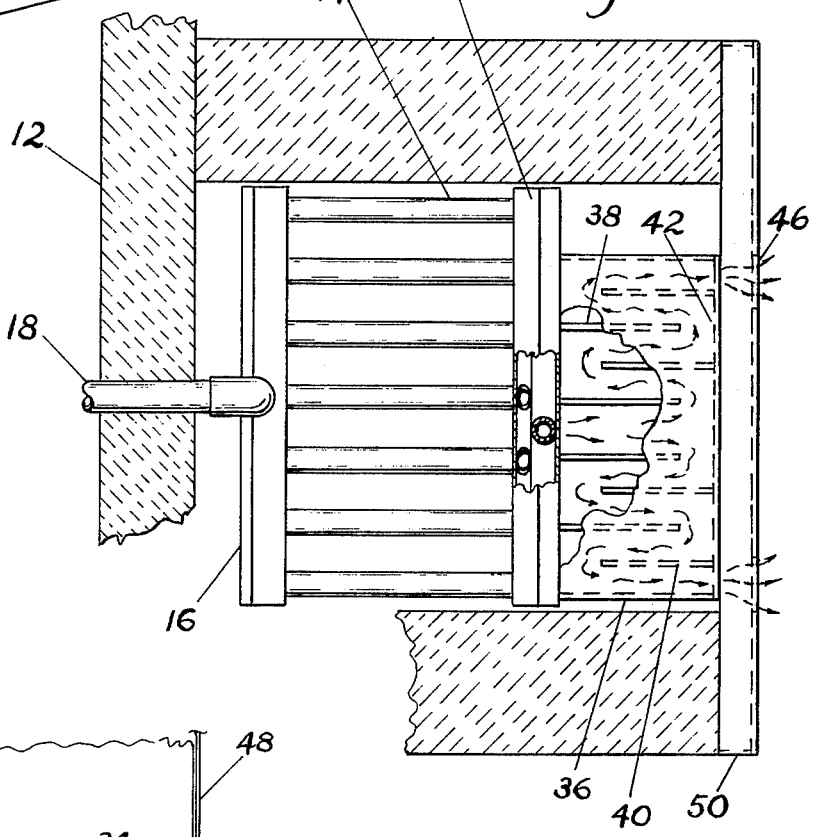
FIG. 3 is a top plan view of the invention.

The housing 36 is provided with a plurality of vertical spaced baffles 38 in the rear thereof and 40 in the front thereof with the rear baffles 38 extending short of the front 42 of the housing and the front baffles extending short of the rear wall 44 of the housing 36 so as to form a tortuous path, as best seen in FIG. 3 for the flow of heated air through the housing 36. The front sides 42 of the baffle housing are provided with openings 46 for distribution of the heated air into the room. The support channel 50 provides space under the glass doors and their guide rail for the warm air passage in line with baffle housing. This is a neat and nice looking arrangement and puts the warm air close to the floor where it should be.

Figure 1:
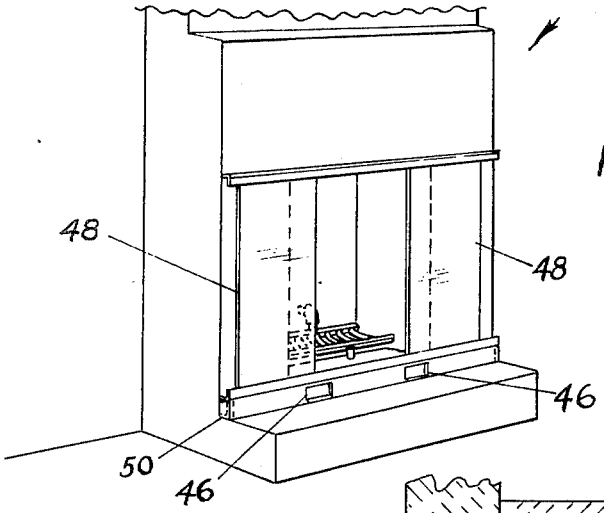
FIG. 1 is a perspective view of the invention embodied in the present invention.

The fireplace is further provided with sliding glass doors 48, shown in a partially opened position in FIG. 1 to permit access to the grate for inserting logs thereon and to prevent smoke and ashes from entering the room to be heated.

In operation, of course, the logs are placed on the grate and the fire is started and the electrical switch controlling the motor is turned to an "On" position so that the fan will suck the air in through the system and into the tubular members 14 and out of the apertures 26 in order to support combustion in the fireplace. Thereafter, as the air passes through the tubular members 14 it is heated and the fan causes the heated air to be discharged into the baffle housing 36 and enter the room through the ducts 46.

From the foregoing description, it is apparent that the present invention provides a novel and unique fireplace system which brings in fresh air to be heated from outside under forced draft so as to make the inside air pressure in the room to be heated higher than the outside pressure and thus prevents leakage of cold air into the house and further provides novel muffler and partition members to route the heated air through all sections of the muffler thereby allowing additional heat from the fire to be absorbed in the dwelling.

Inasmuch as various changes may be made in the location of the several parts, without departing from the scope of the invention, it is not meant to limit the invention except by the scope of the following claims.

What is claimed is:

1. A fireplace device comprising a plurality of arcuate hollow tubular members for holding logs, disposed in a fireplace, a rear header connected to said tubular members, an air inlet pipe connected to said rear header, a housing disposed at the rear of the fireplace and outside the back wall of the fireplace, a motor and intake fan in said housing to supply cold outside air to said inlet pipe and rear header and tubular members, a front header connected to the front end of said tubular members and disposed in the fireplace, a substantially horizontal housing connected to said front header and disposed in the fireplace to receive hot air from said hollow members, a plurality of apertures in said hollow members to supply fresh air from combustion, glass panels closing off the front of the fireplace to prevent air from the room in which it is located from entering the fireplace, said horizontal housing having a central inlet adjacent its rear to receive heated air from said front header and oppositely disposed hot air outlets below said glass panels, and a plurality of vertical alternating panels in said horizontal housing to force heated air to pass therethrough in a tortuous path before discharge through its outlets.

2. The devide of claim 1 wherein the alternating panels are connected to the front and back of said horizontal housing with one attached to the front and the next adjacent one attached to the rear.

* * * * *